US007798237B2

(12) United States Patent
Korach et al.

(10) Patent No.: US 7,798,237 B2
(45) Date of Patent: Sep. 21, 2010

(54) ENCLOSED COILED TUBING RIG

(75) Inventors: Donovan Korach, Anchorage, AK (US); Drew Byers, Anchorage, AK (US)

(73) Assignee: Nabors Alaska Drilling, Inc., Anchorage, AK (US)

( * ) Notice: Subject to any disclaimer, the term of this patent is extended or adjusted under 35 U.S.C. 154(b) by 291 days.

(21) Appl. No.: 11/847,437

(22) Filed: Aug. 30, 2007

(65) Prior Publication Data

US 2009/0056953 A1 Mar. 5, 2009

Related U.S. Application Data

(60) Provisional application No. 60/916,512, filed on May 7, 2007.

(51) Int. Cl.
*E21B 19/22* (2006.01)

(52) U.S. Cl. ..... 166/379; 166/77.2; 166/77.3; 166/901

(58) Field of Classification Search ..... 166/75.11, 166/77.1–77.3, 356, 379, 381, 901; 175/85, 175/219
See application file for complete search history.

(56) References Cited

U.S. PATENT DOCUMENTS

| | | | | |
|---|---|---|---|---|
| 3,628,521 | A | 12/1971 | Hodges | |
| 3,841,407 | A * | 10/1974 | Bozeman | 166/384 |
| 4,249,600 | A | 2/1981 | Bailey | |
| 4,899,823 | A * | 2/1990 | Cobb et al. | 166/351 |
| 4,899,832 | A * | 2/1990 | Bierscheid, Jr. | 173/187 |
| 5,248,005 | A * | 9/1993 | Mochizuki | 175/85 |
| 5,411,085 | A | 5/1995 | Moore et al. | |
| 5,738,173 | A | 4/1998 | Burge et al. | |
| 5,823,267 | A * | 10/1998 | Burge et al. | 166/385 |
| 5,842,530 | A * | 12/1998 | Smith et al. | 175/162 |
| 6,003,598 | A * | 12/1999 | Andreychuk | 166/76.1 |
| 6,017,082 | A | 1/2000 | Leoni | |
| 6,230,805 | B1 | 5/2001 | Vercaemer et al. | |

(Continued)

FOREIGN PATENT DOCUMENTS

WO WO 2008/137914 A1 11/2008

OTHER PUBLICATIONS

Gantt et al., "Coiled Tubing Drilling on the Alaskan North Slope," *Oilfield Review*, pp. 20-35 (Summer 1998).

(Continued)

*Primary Examiner*—David J Bagnell
*Assistant Examiner*—Blake Michener
(74) *Attorney, Agent, or Firm*—Haynes and Boone, LLP

(57) ABSTRACT

An enclosed coiled tubing apparatus which includes a mobile trailer and a coiled tubing unit releasable coupled thereto, and a enclosure to maintain an adequate temperature, where the coiled tubing unit includes a coiled tubing injector postionally fixed relative to a coiled tubing reel so as to move together relative to the trailer as an integral unit. The coiled tubing reel and injector may travel laterally on the trailer on a track. Also included are methods of extending a wellbore in a subterranean formation by: translating a coiled tubing unit within an enclosure to a first position and then inserting a bottom hole assembly (BHA) into the wellbore using a lifting system, and wherein the coiled tubing unit includes coiled tubing; and translating the coiled tubing unit to a second position and then coupling the coiled tubing to the BHA and operating the BHA to extend the wellbore.

20 Claims, 7 Drawing Sheets

U.S. PATENT DOCUMENTS

| | | | | |
|---|---|---|---|---|
| 6,273,188 | B1 | 8/2001 | McCafferty et al. | |
| 6,408,955 | B2 | 6/2002 | Gipson | |
| 6,457,520 | B2 * | 10/2002 | Mackenzie et al. | 166/242.7 |
| 6,457,534 | B1 * | 10/2002 | Rolovic et al. | 166/381 |
| 6,502,641 | B1 | 1/2003 | Carriere et al. | |
| 6,536,539 | B2 | 3/2003 | Merecka et al. | |
| 6,554,075 | B2 * | 4/2003 | Fikes et al. | 166/379 |
| D483,299 | S | 12/2003 | McCafferty et al. | |
| 6,672,407 | B2 * | 1/2004 | Streich | 175/58 |
| 6,763,890 | B2 | 7/2004 | Polsky et al. | |
| 6,971,547 | B2 | 12/2005 | Englert et al. | |
| 7,185,708 | B2 * | 3/2007 | Wood et al. | 166/379 |
| 7,255,180 | B2 * | 8/2007 | Beato et al. | 175/5 |
| 2001/0015274 | A1 | 8/2001 | Gipson | |
| 2002/0029907 | A1 | 3/2002 | Carriere et al. | |
| 2003/0098150 | A1 * | 5/2003 | Andreychuk | 166/77.2 |
| 2004/0182574 | A1 | 9/2004 | Adnan et al. | |
| 2006/0000619 | A1 * | 1/2006 | Borst et al. | 166/384 |
| 2006/0207767 | A1 * | 9/2006 | Andreychuk | 166/379 |
| 2006/0257258 | A1 | 11/2006 | Zwebner | |
| 2006/0260844 | A1 | 11/2006 | Patton et al. | |
| 2006/0283587 | A1 * | 12/2006 | Wood et al. | 166/77.2 |
| 2007/0125551 | A1 * | 6/2007 | Havinga | 166/384 |
| 2007/0221386 | A1 * | 9/2007 | Rock et al. | 166/379 |
| 2007/0284113 | A1 * | 12/2007 | Haheim | 166/345 |
| 2008/0173480 | A1 * | 7/2008 | Annaiyappa et al. | 175/24 |

OTHER PUBLICATIONS

Cassee et al., "True Hybrid Operations Combining Coiled Tubing Drilling and Conventional Rig Workover Techniques and Practices," *Reel Reporter*, Newsletter of the International Tubing Association, vol. 9, Issue 2, pp. 2-9 (May 2004).

* cited by examiner

ENCLOSED COILED TUBING RIG

CROSS REFERENCE TO RELATED APPLICATIONS

This application claims the benefit of U.S. Provisional Application No. 60/916,512, entitled "ENCLOSED COILED TUBING RIG," filed May 7, 2007, the disclosure of which is hereby incorporated herein by reference.

BACKGROUND

Coiled tubing drilling offers the advantages of reduced time and costs associated with conventional drilling operations that utilize segmented pipe. These advantages include reduced pipe handling time, reduced pipe joint makeup time, and reduced leakage risks.

However, when coiled tubing drilling is utilized, conventional drilling may still be required to drill surface holes due to the lack of bit weight at the surface with coiled tubing drilling. A separate conventional drilling rig is then required to drill a surface hole, place surface casing, cement, and then drill to deeper depths. Thus, hybrid rigs exist that can perform both conventional drilling and coiled tubing drilling.

However, hybrid rigs are often utilized in extremely cold environments, such as Alaska. These rigs typically feature a fixed coiled tubing reel location, which is cumbersome and difficult to position and operate, particularly in extremely cold environments. Moreover, the entire coiled tubing unit (e.g., reel and injector) is exposed to the cold environment, and can be subject to freeze-up or other weather-induced failure.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
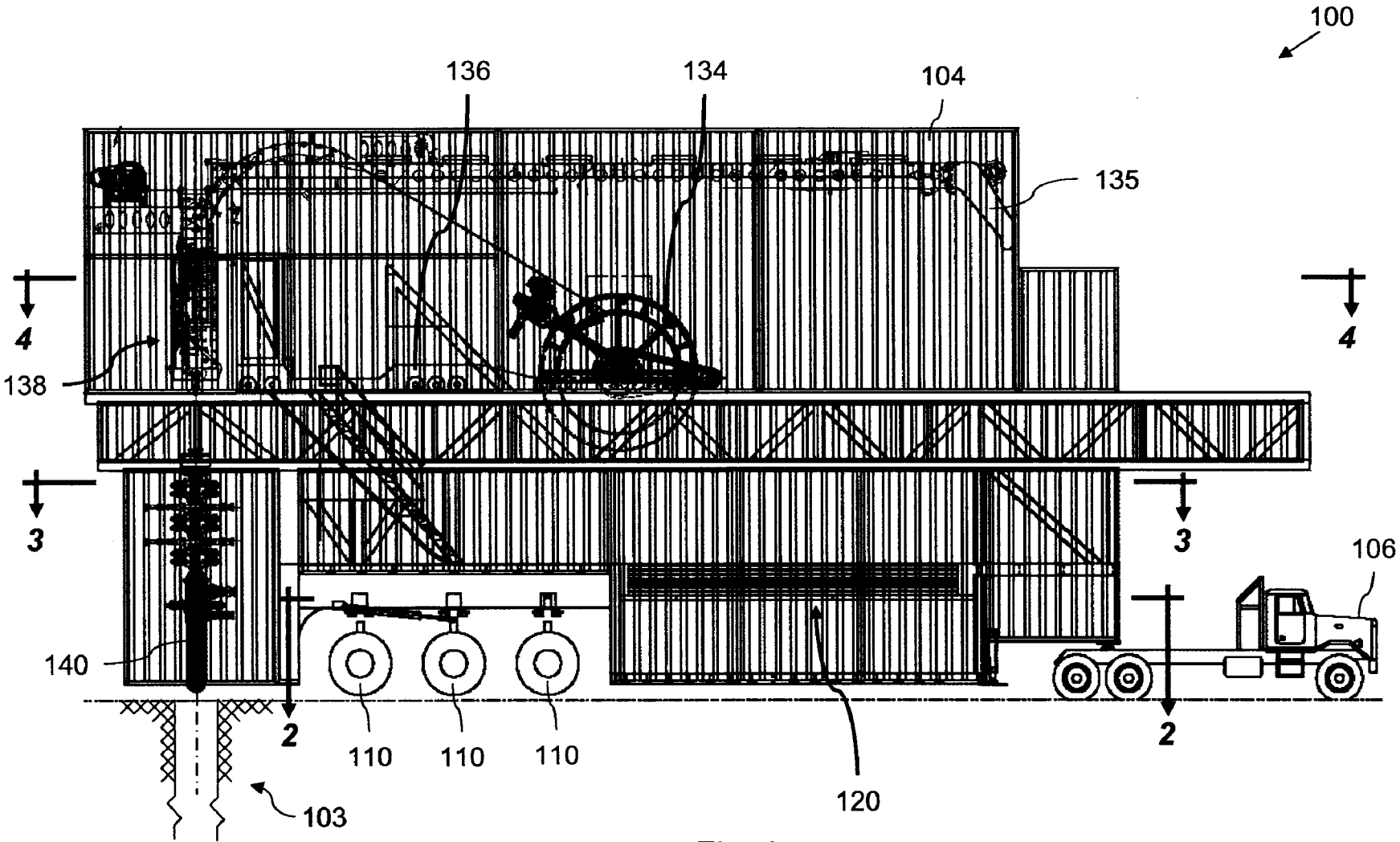
FIG. 1 is a side view of a coiled tubing rig according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

FIG. 1 is a partial sectional view of a coiled tubing rig 100 in a traveling configuration according to one or more aspects of the present disclosure. The coiled tubing rig 100 is fully enclosed within an exterior wall 104. Being fully enclosed within the exterior wall 104 allows drilling equipment and other components of the coiled tubing rig 100 to more easily be maintained at an adequate temperature and, thereby, eliminate freeze up. For example, the exterior wall 104 shields the interior of the rig 100 from wind and other harsh elements of cold environments, and may also help to prevent the escape of any thermal energy generated inside the interior of the rig 100. Alternatively, the exterior wall 104 may shield the interior of the rig 100 from other weather elements in environments other than cold environments, such as by protecting the interior of the rig 100 from sand or other airborne debris which may exist in warmer environments (e.g., the desert).

Figure 2:
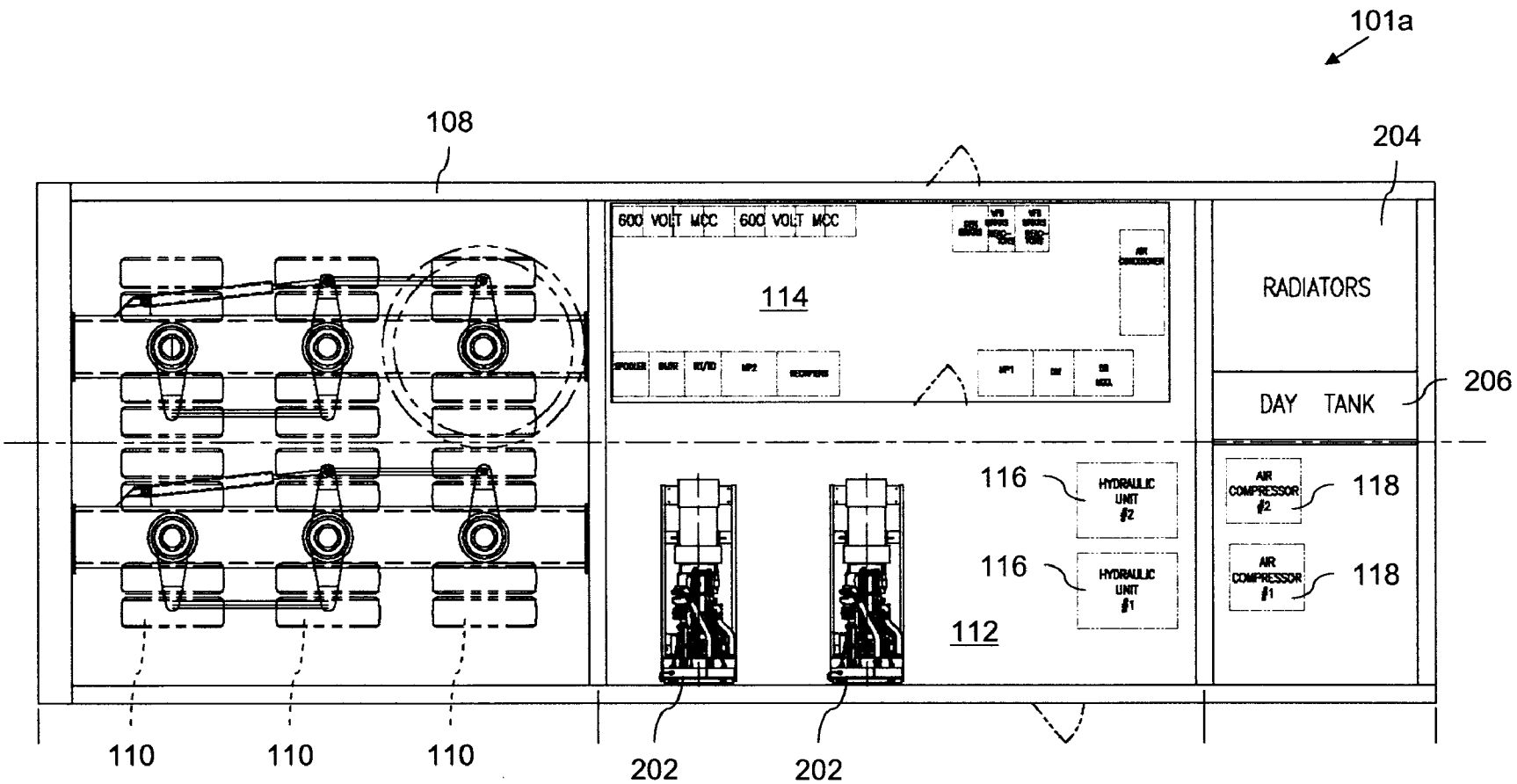
FIG. 2 is a sectional plan view of the apparatus shown in FIG. 1.

FIG. 2 is a sectional plan view of a first level 101*a* of the coiled tubing rig 100 shown in FIG. 1. Referring to FIGS. 1 and 2, collectively, the coiled tubing rig 100 is designed to be transported by a truck 106 and is constructed as a mobile trailer having, for example, bottom structural framework that includes wheels 110 that support the coiled tubing rig 100 during travel. The first level 101*a* includes an engine room 112 and a motor control center 114 positioned in front of the wheels 110, as well as one or more hydraulic units 116 and air compressors 118.

The engine room 112 houses one or more motor/generator sets 202. Each motor/generator set 202 may be or comprise, for example, a Caterpillar C18 motor/generator set rated at 735 BHP at 1200 rpm. The motor control center 114 may include variable frequency drive technology to provide variable AC power to the drilling and support machinery. The motor control center 114 may also include the ability to utilize incoming electrical power, such as incoming 13.8 kV power, when available. Radiators 204 and a day tank 206 may also be housed within the first level 101*a*, and may be positioned forward of the motor control center 114, as shown in FIG. 2.

Figure 3:
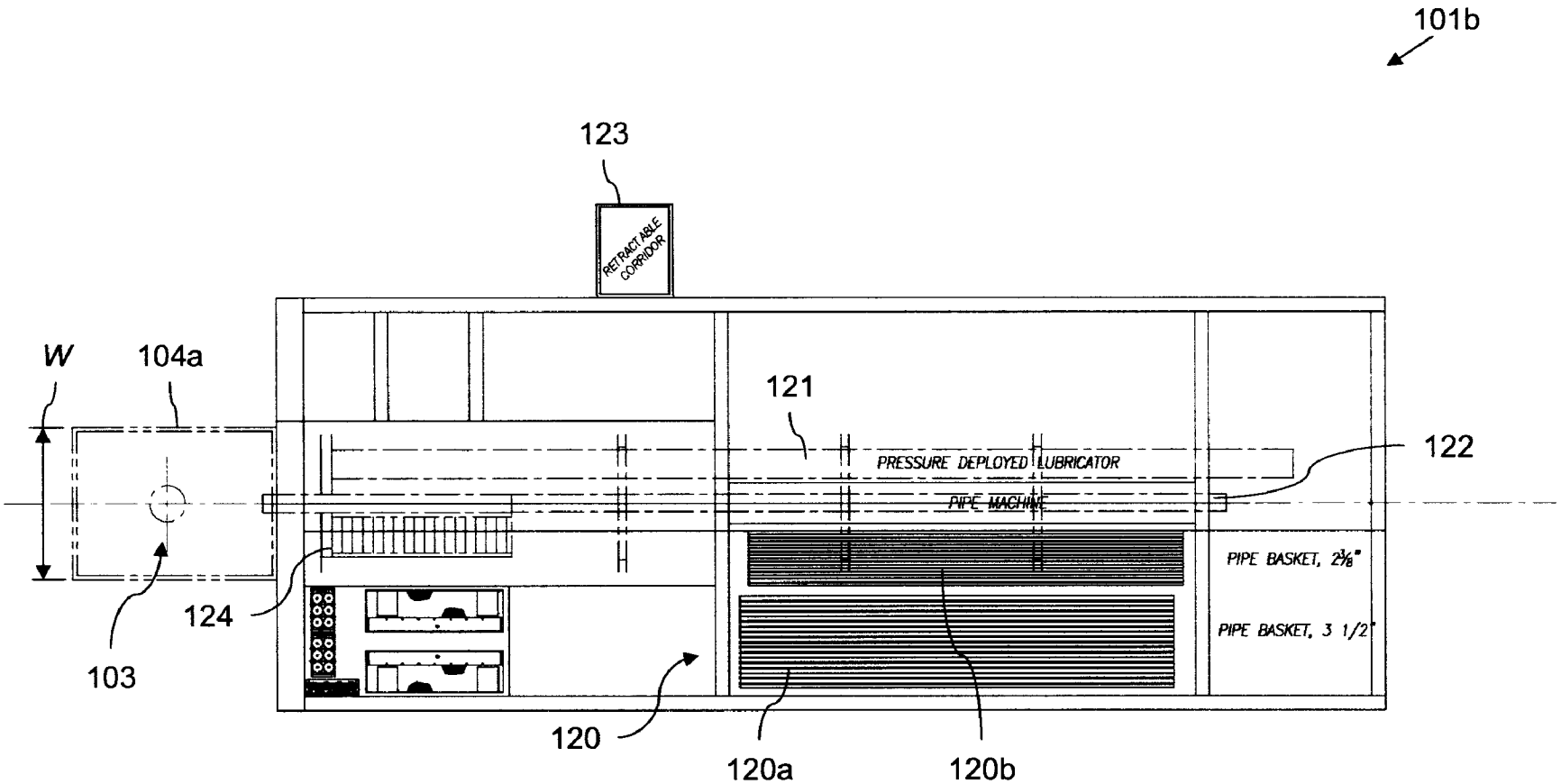
FIG. 3 is another sectional plan view of the apparatus shown in FIG. 1.

FIG. 3 is a sectional plan view of a second level 101*b* of the coiled tubing rig 100 shown in FIGS. 1 and 2. Referring to FIGS. 1 and 3, collectively, the coiled tubing rig 100 includes one or more pipe sheds 120, such as may be located above the engine room 112. For example, one pipe shed 120 may include two independent, hydraulically controlled pipe tubs, such as a first tub 120*a* capable of housing 100 joints of 3½" pipe and a second tub 120*b* capable of housing 100 joints of 2⅜" pipe. The pipe shed 120 may have a capacity of 8,000 lbs of 20" maximum diameter pipe, and may accommodate tubulars with a 45'-0" maximum length, although other configurations are also within the scope of the present disclosure. The coiled tubing rig 100 also includes a pressure deployment lubricator ("PDL") 121 and a pipe handler system 122, such as, for example, a Columbia Pipe Handler System, although these are depicted by dashed lines in FIG. 3 as they are not always positioned proximate to the second level 101*b* of the rig 100.

The pipe shed 120 may also include or be configured for operation in conjunction with one or more bottom hole assembly racks and rollers, although other configurations are also within the scope of the present disclosure. The pipe shed 120 may also include or be configured for operation in conjunction with one or more overhead cranes. In an exemplary embodiment, the pipe shed 120 contains two independent 5-ton overhead cranes, along with a set of Lil Jerk tongs for assistance in making-up/breaking-out bottom hole assembly (BHA) components, although other configurations are also within the scope of the present disclosure.

During operation, the exterior wall 104 surrounds the pipe housed within the pipe shed 120, and also surrounds the PDL 121 and pipe machine 122. Consequently, the pipe in the pipe shed 120, the PDL 121 and the pipe machine 122 are protected from the external environment. Thus, for example, a minimum temperature of the pipe in the pipe shed 120, the PDL 121 and the pipe machine 122 may be maintained despite high winds and/or freezing temperatures outside of the exterior wall 104.

The coiled tubing rig 100 may also include a retractable corridor 123 extending from one side for providing a temporary or permanent walkway to an adjacent mud pit, rig, facility and/or other structure. One or more ladders or stairways 124 may also provide human access between the levels of the rig 100.

The exterior wall 104 of the rig 100 may be configured to further enclose a blow out preventer (BOP) 140 (or more than one BOPs, hereafter collectively referred to as the BOP 140). For example, a portion 104*a* of the exterior wall 104 may be configured to enclose the BOP 140 and, as such, may be substantially centered around the wellbore 103. This portion 104*a* of the exterior wall 104 may be smaller in width W and/or other dimensions relative to the remainder of the exterior wall 104, such that the smaller enclosed volume around the BOP 140 may further aid in maintaining the BOP 140 above a predetermined temperature. In an exemplary embodiment, the predetermined temperature may be about 40° F., although other temperatures above 32° F. are also within the scope of the present disclosure. Nonetheless, the portion 104*a* of exterior wall 104 surrounding the BOP 140 may also have substantially the same width as the remainder of the exterior wall 104, or may be otherwise configured within the scope of the present disclosure.

The BOP 140 may extend from a lower point proximate the opening of the wellbore 103 and upwards beyond the first and second levels 101*a*, 101*b* of the rig 100. Thus, while the BOP 140 is not shown in FIG. 3, its position relative to other components of the rig 100 it is understood, at least in part by its depiction in FIG. 1. Nonetheless, it should also be understood that the BOP 140 is configured to be laterally positioned proximate to the opening of the wellbore 103 by positioning of the rig 100, as depicted in FIG. 1. However, the rig 100 may include positioning means to align the BOP 140 with the wellbore 103 other than with (or in addition to) positioning of the rig 100.

Figure 4:
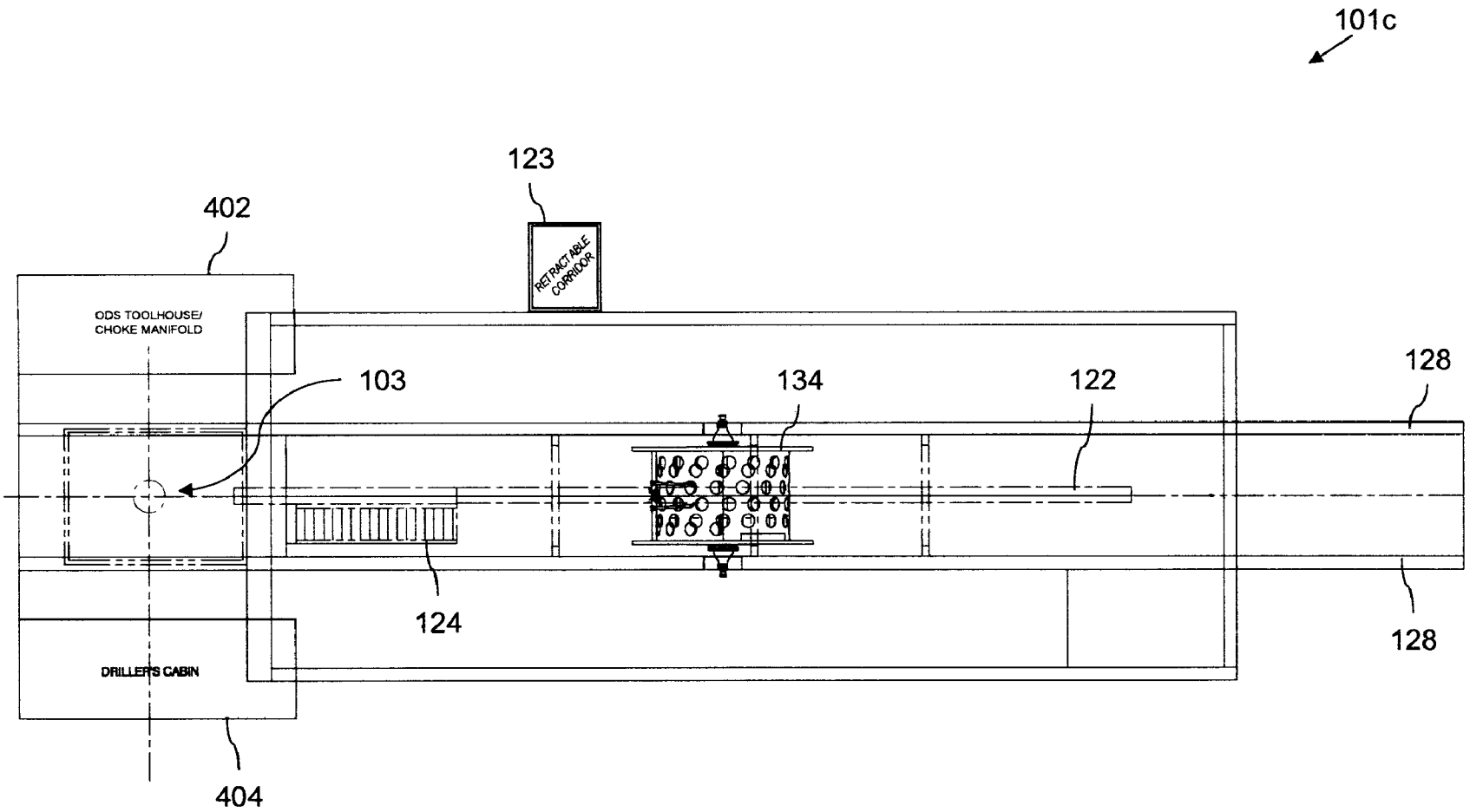
FIG. 4 is another sectional plan view of the apparatus shown in FIG. 1.

FIG. 4 is a sectional plan view of a third level 101*c* of the coiled tubing rig 100 shown in FIGS. 1-3. Referring to FIGS. 1 and 4, collectively, the coiled tubing rig 100 includes a coiled tubing reel drive system that travels on structural rails 128 which extend the substantial length of the coiled tubing rig 100. In an exemplary embodiment, the coiled tubing reel drive system is or comprises a coiled tubing reel drive system manufactured by Foremost Industries. The coiled tubing reel drive system may include a coiled tubing reel 134 and, for example, a 50 ton lift system 135 for raising and lowering the coiled tubing reel. In FIG. 1, the lift system 135 is shown in a traveling configuration in which it is collapsed for storage within the exterior wall 104. In FIG. 4, the lift system 135 is not shown because, in its stored or collapsed configuration, it is positioned above the section cut of FIG. 4. However, FIG. 4 does depict that the pipe machine 122 and coiled tubing reel 134 are mutually aligned or centered, and that both may be centered relative to the rig 100 and/or the wellbore 103.

As best shown in FIG. 1, the coiled tubing rig 100 also includes a coiled tubing injector drive cart 136 which also travels on the structural rails 128. The coiled tubing injector drive cart 136 holds a coiled tubing injector 138, such as, for example, a coiled tubing injector M100 made by Stewart and Stevenson. The coiled tubing reel drive system and the coiled tubing injector drive cart 136 may be linked together for concurrent movement along the structural rails 128, or they may be driven independently on the rails 128. In an exemplary embodiment, the coiled tubing reel drive system and the coiled tubing injector drive cart 136 are manufactured as an integral unit and, thus, travel along the structural rails 128 together. Whether formed as an integral unit or as discrete components that are mechanically coupled together, the integrated handling system configured to position the coiled tubing reel drive system and the coiled tubing injector drive cart 136 together as a single unit allows the weight of the coiled tubing rig 100 to be balanced forward and aft for moving the coiled tubing rig 100. The handling system also provides the proper distance between the coiled tubing injector 138 and the coiled tubing reel 134, such as for spooling purposes.

As shown in FIG. 4, the coiled tubing rig 100 may include an additional retractable corridor 123 extending from one side for providing a temporary or permanent walkway to an adjacent mud pit, rig, facility and/or other structure. One or more ladders or stairways 124 may also provide human access between the levels of the rig 100.

The rig 100 may also include a driller's cabin 404 and/or an ODS toolhouse/choke manifold 402. In an exemplary embodiment, the dimensions of the driller's cabin 404 may be about 10' W×23' L×10' H, although other sizes are also within the scope of the present disclosure. Machinery automation and low noise levels within the driller's cabin 404 may be such that operators are provided with a calm environment in which to work. The coiled tubing injector 138 push/pull and block hoisting/lowering may be controlled by a joystick or other human-machine interface from within the cabin 404.

Quality of work and important decision making are improved in this atmosphere. The console and other control panels within the driller's cabin 404 are configured to allow personnel to complete regular shifts without stress or strain, despite the harsh environment outside of the cabin 404. Operational controls and parameters, such as hook load, block height, speed and rate of penetration (ROP), as well as status and alarms, may be accessed via touch screens connected to the drilling control network. The control system may include several features configured to help the driller optimize efficiency and safety of operation, including: coiled tubing tension minimum and maximum set points; coiled tubing stress analysis and life management; managed pressure choke control; block position limits (crown saver and floor saver); block speed limits (safety limits, swab, surge and casing speed); driller's set points (stopping positions); overpull limits and snubbing limits; drilling and tripping process screens; pit volume, flow, and pit valve control. The electronic drilling control algorithms help drillers significantly reduce drilling costs and improve rig safety. Superior drilling performance may be achieved by precisely monitoring or maintaining up to four parameters simultaneously: weight on bit (WOB), ROP, drilling torque and delta-P (differential downhole motor pressure). These design features may provide consistent, steady-state control at the drill bit, which may result in longer bit life, optimum bit performance, reduced bit usage and reduced bit trips. This system may also help improve directional drilling control and accuracy.

The rig 100 may further comprise a top drive, such as, for example, a 150 Ton Foremost Model F-150T AC Top Drive. The rig 100 may also include drawworks, such as, for example, a Pacific Rim Commander 350, as well as a pedestal configured to support the mast of the list system 135. One or more of these components may be mounted at the rear of the rig 100. A rotary table may be used either in lieu of, or in conjunction with, the top drive. The coiled tubing rig 100 is configured for drilling with coiled tubing or with a top-drive and mast configuration. The mast may be positioned horizontally over the top of the coiled tubing reel 134 during traveling, as in the configuration shown in FIG. 1.

Figure 5:
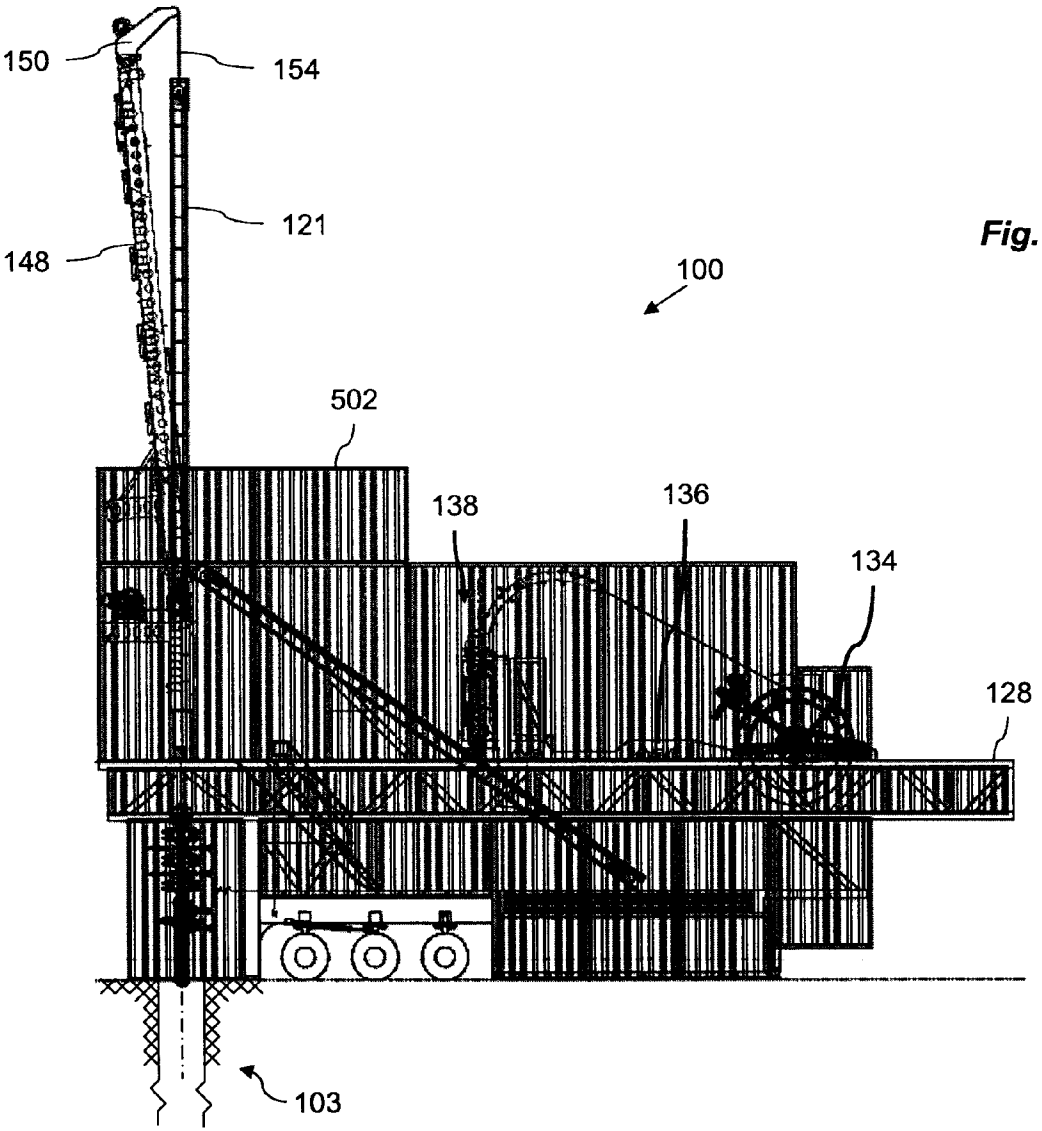
FIG. 5 is a side view of the apparatus shown in FIG. 1 in a pressure deployment lubricator handling configuration according to one or more aspects of the present disclosure.

Referring to FIG. 5, the coiled tubing rig 100 is shown in a lubricator handling configuration. In the lubricator handling configuration, roof doors 502 are opened and the mast 148 of the lift system 135 is raised to a vertical position. After opening, the roof doors 502 may be lowered for increased strength and rigidity during high winds. The coiled tubing injector drive cart 136 and coiled tubing reel drive system, including the reel 134, are moved to a forward position on the main structural rails 128.

The mast 148 includes a boom arm 150 located at the crown of the mast. A cable 154 extends from the boom arm 150 and, in the embodiment shown in FIG. 5, is connected to and supports the weight of the PDL 121. In operation, the pipe shed 120 is configured to allow for BHA components to be made-up, electrically tested for continuity, and then inserted into the PDL 121. The PDL 121 and BHA are then raised into a substantially vertical position by the mast 148, as shown in FIG. 5. The PDL 121 may be raised to a clear height of 95' through the use of the boom arm 150 and in conjunction with tilting the mast 148 five degrees towards the rear of the coiled tubing drilling rig 100. The BHA may then be deployed into the wellbore 103 following conventional procedures. Following deployment of the BHA, the PDL 121 may be racked back to the mast 148 or otherwise stored.

Figure 6:
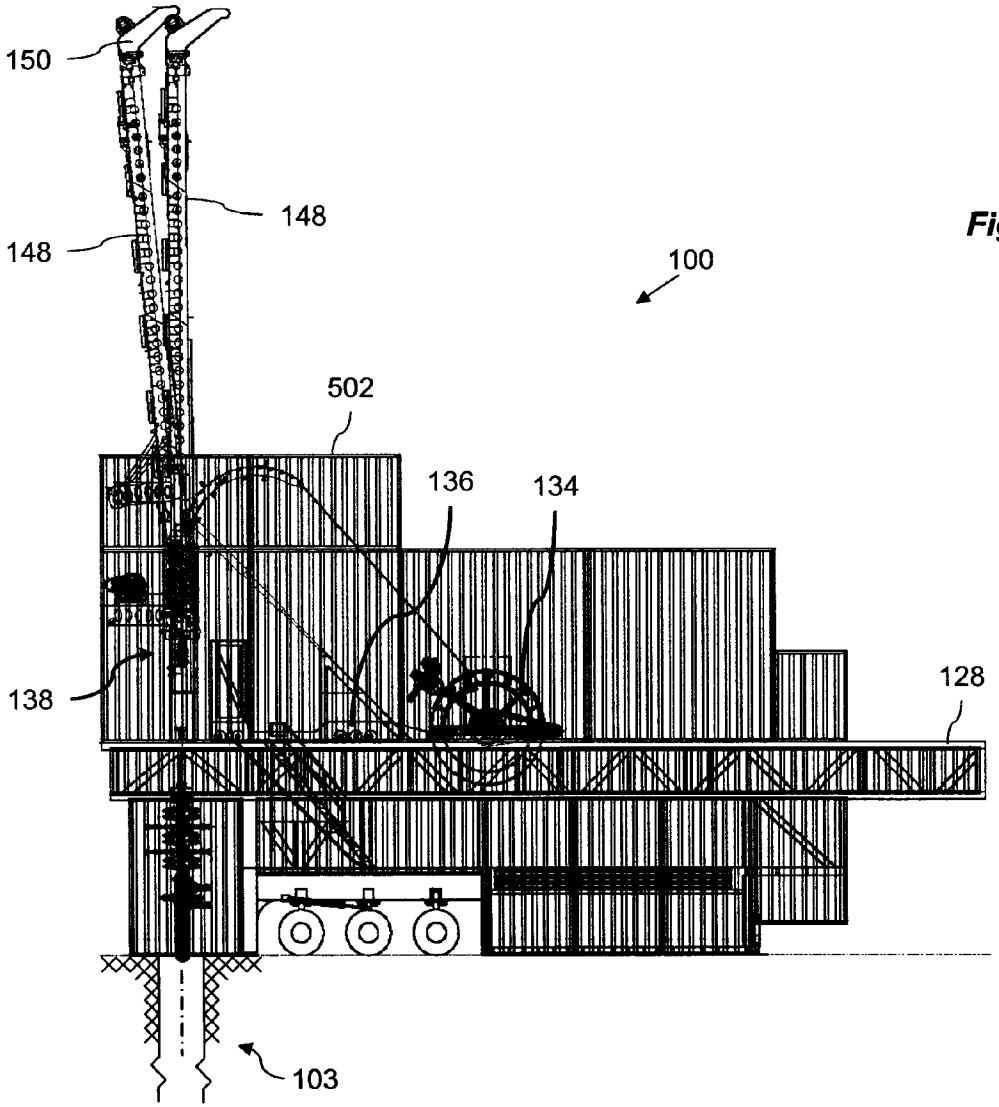
FIG. 6 is a side view of the apparatus shown in FIG. 1 in a drilling configuration according to one or more aspects of the present disclosure.

Referring to FIG. 6, the coiled tubing rig 100 is shown in a drilling configuration. The coiled tubing injector drive cart 136 and coiled tubing reel drive system are moved to a rearward position on the main structural rails 128. The coiled tubing injector 138 may be raised for mounting to the PDL 121, while maintaining the necessary coiled tubing tension back to the coiled tubing reel 134. For demonstration purposes, the mast 148 is depicted in FIG. 6 in both the PDL handling configuration of FIG. 5 and in the drilling configuration of FIG. 6. Of course, it is understood that the rig 100 does not necessarily include two separate masts 148, as shown in FIG. 6.

During operation, the exterior wall 104 surrounds a portion of coiled tubing 134*a* that extends from the coiled tubing reel 134 to the coiled tubing injector 138. Consequently, this portion of the coiled tubing 134*a*, as well as the coiled tubing reel 134 and injector 138, are protected from the environment. Thus, for example, a minimum temperature of the coiled tubing 134*a*, reel 145 and injector 138 may be maintained despite high winds and/or freezing temperatures outside of the exterior wall 104.

In an exemplary embodiment, the enclosed coiled tubing rig 100 shown in FIGS. 1-6 may further comprise one or more heaters coupled to the structure of the trailer internal to the enclosure 104. For example, the rig 100 may include two 2.5MM BTU heaters each operable at 20 gal/hr. The heater(s) may be positioned on any of the levels 101*a*, 101*b*, 101*c* of the rig 100, or elsewhere within the rig 100. In one embodiment, each level of the rig 100 includes at least one heater. The one or more heaters may be configured to maintain the internal temperature of the rig 100, internal to the exterior wall 104, at or above a minimum temperature. For example, the minimum temperature may be about 40° F., although other temperatures are also within the scope of the present disclosure.

Figure 7:
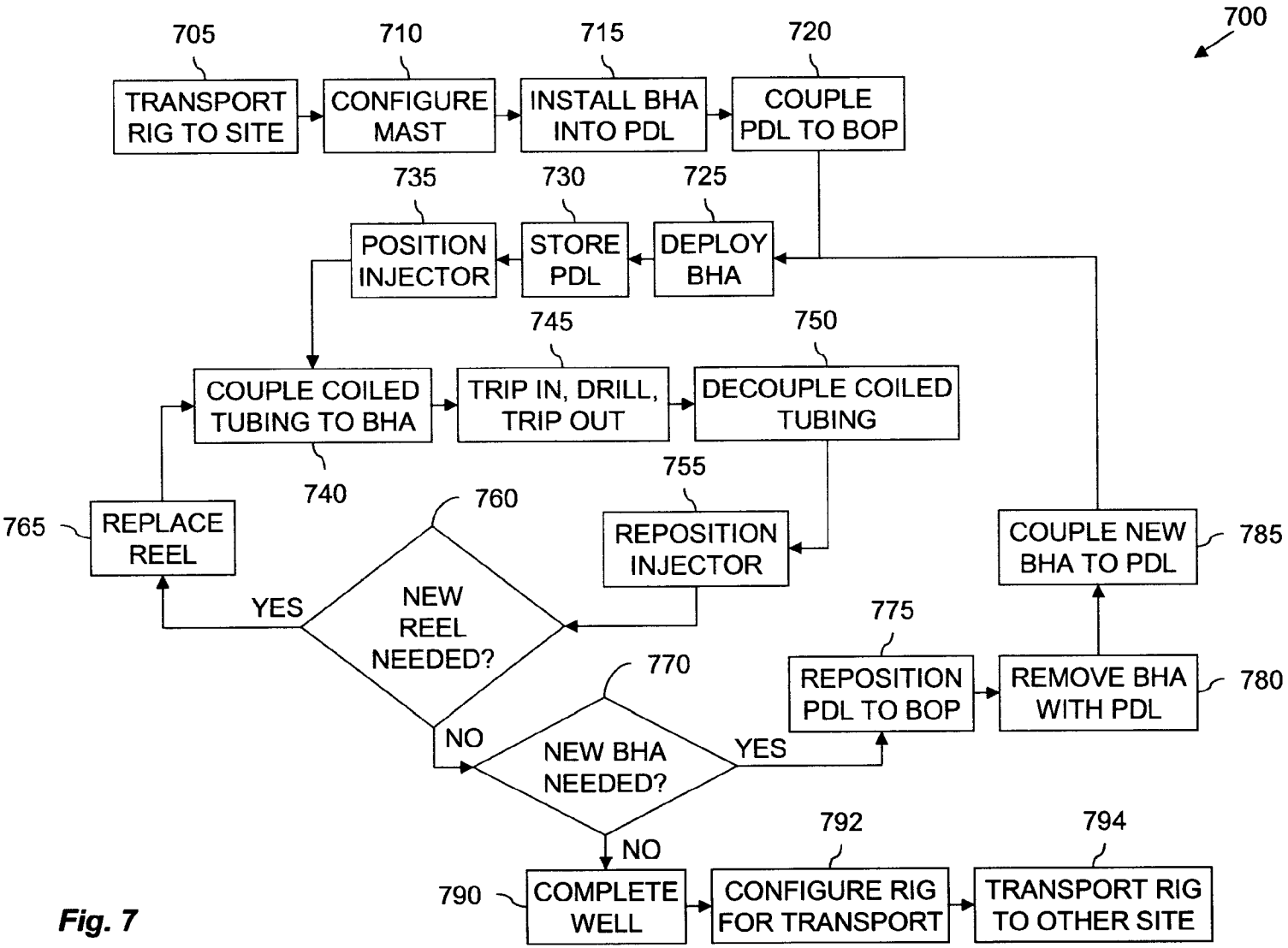
FIG. 7 is a flow-chart diagram of at least a portion of a method according to one or more aspects of the present disclosure.

FIG. 7 is a flow-chart diagram of at least a portion of an operational method 700 for the coiled tubing rig 100 shown in FIGS. 1-6 according to one or more aspects of the present disclosure. Referring to FIG. 7, with continued reference to FIGS. 1-6, the method 700 includes a step 705 in which the coiled tubing rig 100 is transported to the well-site. For example, In a subsequent step 710, the mast 148 is configured. For example, the roof doors 502 may be opened and the mast 148 may be raised and possibly tilted back (e.g., away from the coiled tubing reel 134, perhaps by about five degrees) in preparation for raising the PDL 121. A bottom hole assembly (BHA) may then be inserted into the PDL 121 in a step 715. Thereafter, the PDL 121 may be picked up from the pipe shed 120 using the mast 148, and the PDL 121 may be coupled to the BOP 140 in a step 720.

The BHA may then be deployed into the wellbore in a step 725. In a subsequent step 730, the PDL 121 stowed. For example, the PDL 121 may be racked back to the mast 148 in a vertical storage position. Thereafter, in a step 735, the coiled tubing injector 138 and the coiled tubing injector drive cart 136 may be translated from their forward position (or elsewhere they may remain positioned during handling of the PDL 121) and positioned over the wellbore center. The coiled tubing may then be coupled to the BHA in a step 740. In a subsequent step 745, the drill string is lowered in the well bore ("trip-in"), drilling operations are undertaken, and the drill string is brought out of the well bore (trip-out") with the BHA brought to the top of the well bore. The coiled tubing and BHA may then be decoupled in a step 750, and the coiled tubing injector 138 and the coiled tubing injector drive cart 136 may be translated away from the well center in a subsequent step 755.

A decisional step 760 is then performed to determine whether a new coiled tubing reel 134 is needed. If a new reel 134 is needed, a step 765 is performed, during which the existing reel may be translated by the coiled tubing reel drive system 132 to a forward position on the main structural rails 128, where the lift system may lower the used coiled tubing reel for replacement with a new coil tubing reel. The coiled tubing reel drive system 132 may then return the coiled tubing reel 134 to a position where the coiled tubing may be coupled to the BHA as step 740 and subsequent steps are repeated.

If a new coiled tubing reel is not needed, as determined during decisional step 760, a decisional step 770 may be performed to determine whether a new BHA may be needed, such as in response to dulling of the drill bit. If a new BHA is needed, a step 775 is performed, during which the PDL 121 may be repositioned to the BOP 140 from its racked position on the mast 148. In a subsequent step 780, the BHA may be pulled into the PDL 121 and the PDL 121 may be released from the BOP 140. Thereafter, in a step 785, the PDL 121 containing the used BHA may then be lowered into the pipe shed 120 where a new BHA may be inserted into the PDL, and the PDL 121 with the new BHA may be picked up from the pipe shed 120 by the mast 148 and coupled to the BOP 140. The method 700 may then proceed to repeat step 725 and subsequent steps.

If a new BHA is not needed, as determined during decisional step 770, a step 790 may be performed, during which the well may be completed. The coiled tubing rig 100 may then be returned to its traveling configuration 102 in a subsequent step 792 by, for example, returning the PDL 121 containing the BHA to the pipe shed 120, lowering the mast 148, closing the roof doors 502, and returning the coiled tubing injector drive cart 136, coiled tubing injector 138 and the coiled tubing reel drive system 132 to their traveling positions. In an optional step 794, the coiled tubing rig 100 may be transported to another well site.

In view of the above and the figures, it should be apparent to those skilled in the art that the present disclosure introduces an apparatus comprising a mobile trailer, a coiled tubing unit coupled to the mobile trailer, and an enclosure surrounding the coiled tubing unit. The coiled tubing unit may comprise a coiled tubing reel and a coiled tubing injector, wherein the reel and the injector are positionally fixed relative to one another and collectively move relative to the mobile trailer as an integral unit. At least one of coiled tubing deployment, coiled tubing retraction, and lateral translation of the coiled tubing unit relative to the trailer may be configured to be substantially automated. The apparatus may further comprise a track extending at least a portion of the length of the trailer, wherein the coiled tubing unit is configured to translate along the track laterally relative to the trailer. The enclosure may surround a portion of coiled tubing that extends from the coiled tubing reel to the coiled tubing injector. The apparatus may further comprise a pipe shed coupled to the trailer, wherein the pipe shed is enclosed by the enclosure and is configured to receive a plurality of pipe segments. The apparatus may further comprise a lifting system configured to transfer the pipe segments from the pipe shed. The apparatus may further comprise a heater coupled to the trailer internal to the enclosure, such as two 2.5MM BTU heaters each operable at 20 gal/hr. The apparatus may further comprise a pressure deployment lubricator detachably coupled to the trailer. The pressure deployment lubricator may be configured to receive a bottom hole assembly. The apparatus may further comprise a blow-out preventer coupled to the trailer.

The present disclosure also introduces a method comprising, at least in one embodiment, one or more of the following steps: transporting an apparatus as described in the previous paragraph to a drilling site; opening doors in a roof section of the enclosure; rotating a mast of the apparatus between a mast-stored position and a mast-deployed position; translating the coiled tubing unit to a PDL-accessible position; coupling the BHA to the PDL; moving the PDL between a PDL-stored position and a PDL-deployed position; installing the PDL into a wellbore through a blow out preventer component of the apparatus; decoupling the PDL from the BHA; moving the PDL away from the PDL-deployed position; translating the coiled tubing unit to a coiled-tubing-unit-operating position; extending coiled tubing from the coiled tubing unit; coupling the coiled tubing to the BHA; and operating the BHA to extend the wellbore while suspending the BHA within the wellbore from the coiled tubing. Such method may also include one or more of these steps in a sequence other than as listed above.

The present disclosure also provides a method of extending a wellbore in a subterranean formation, comprising translating a coiled tubing unit within an enclosure to a first position and then inserting a bottom hole assembly (BHA) into the wellbore using a lifting system while the coiled tubing unit is in the first position, wherein the coiled tubing unit and at least a portion of the lifting system are enclosed within the enclosure, and wherein the coiled tubing unit comprises coiled tubing, a coiled tubing reel and a coiled tubing injector. The method further comprises translating the coiled tubing unit within the enclosure to a second position and then coupling the coiled tubing to the BHA and operating the BHA to extend the wellbore while the coiled tubing unit is in the second position. Using the lifting system may comprise opening doors in a roof section of the enclosure and rotating a mast of the lifting system through the opened enclosure doors. Inserting the BHA into the wellbore may comprise moving a pressure deployment lubricator (PDL) between a PDL-stored position and a PDL-deployed position and coupling the PDL with the wellbore through a blow out preventer (BOP), wherein the PDL and the BOP are each enclosed within the enclosure. The coiled tubing reel and the coiled tubing injector may be positionally fixed relative to one another and collectively move as an integral unit. The method may further comprise maintaining a temperature internal to the enclosure above a predetermined temperature by operating at least one heater enclosed by the enclosure. The coiled tubing unit and the enclosure may be coupled to a trailer, and the method may further comprise positioning the trailer relative to the wellbore.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An enclosed coiled tubing apparatus, comprising:

a mobile trailer;

a coiled tubing unit releasably coupled to the mobile trailer;

wherein the coiled tubing unit comprises a coiled tubing reel operably associated with a coiled tubing injector, and wherein the reel and the injector are positionally fixed relative to one another and collectively move relative to the mobile trailer as an integral unit, and an enclosure surrounding the coiled tubing unit to maintain an adequate temperature to prevent freeze up.

2. The apparatus of claim 1 wherein at least one of coiled tubing deployment, coiled tubing retraction, and lateral translation of the coiled tubing unit relative to the trailer is configured to be substantially automated.

3. The apparatus of claim 1 wherein the enclosure surrounds a portion of coiled tubing that extends from the coiled tubing reel to the coiled tubing injector.

4. The apparatus of claim 3 wherein the portion is all of the coiled tubing.

5. The apparatus of claim 1 further comprising a track extending at least a portion of the length of the trailer, wherein the coiled tubing unit is configured to translate along the track laterally relative to the trailer.

6. The apparatus of claim 5 wherein the coiled tubing unit translates a distance along the track equivalent to approximately one-third the length of the trailer.

7. The apparatus of claim 1 further comprising a pipe shed coupled to the trailer, wherein the pipe shed is surrounded by the enclosure and is configured to receive a plurality of pipe segments.

8. The apparatus of claim 7 further comprising a lifting system configured to transfer the pipe segments from the pipe shed.

9. The apparatus of claim 1 further comprising at least one heater coupled to the trailer to provide additional heat within the enclosure.

10. The apparatus of claim 1 further comprising a pressure deployment lubricator detachably coupled to the trailer.

11. The apparatus of claim 10 wherein the pressure deployment lubricator is configured to receive a bottom hole assembly.

12. The apparatus of claim 1 further comprising a mast adapted to tilt away from vertical to facilitate positioning of a pressure deployment lubricator and to raise the pressure deployment lubricator into a substantially vertical position.

13. The apparatus of claim 12 wherein the mast is adapted to position the pressure deployment lubricator at a height up to 95 feet when the mast is in a tilted position.

14. The apparatus of claim 12 wherein the coiled tubing injector is supported by a coiled tubing injector drive cart.

15. A method of extending a wellbore in a subterranean formation, comprising:

translating a coiled tubing unit within an enclosure to a first position and then inserting a bottom hole assembly (BHA) into the wellbore using a lifting system while the coiled tubing unit is in the first position, wherein the coiled tubing unit and at least a portion of the lifting system are enclosed within the enclosure, and wherein the coiled tubing unit comprises coiled tubing, a coiled tubing reel and a coiled tubing injector; and translating the coiled tubing unit within the enclosure to a second position and then coupling the coiled tubing to the BHA and operating the BHA to extend the wellbore while the coiled tubing unit is in the second position.

16. The method of claim 15 wherein using the lifting system comprises opening doors in a roof section of the enclosure and rotating a mast of the lifting system through the opened enclosure doors between an operating position and a travel position.

17. The method of claim 15 wherein inserting the BHA into the wellbore comprises moving a pressure deployment lubricator (PDL) between a PDL-stored position and a PDL-deployed position and coupling the PDL with the wellbore through a blow out preventer (BOP), wherein the PDL and the BOP are each enclosed within the enclosure.

18. The method of claim 15 wherein the coiled tubing reel and the coiled tubing injector are positionally fixed relative to one another and collectively move as an integral unit.

19. The method of claim 15 further comprising maintaining a temperature internal to the enclosure above a predetermined temperature by operating at least one heater.

20. The method of claim 15 wherein the coiled tubing unit and the enclosure are coupled to a trailer, and wherein the method further comprises positioning the trailer to the wellbore to deploy coiled tubing into the wellbore.

* * * * *